US008348726B2

(12) United States Patent
Brunner

(10) Patent No.: US 8,348,726 B2
(45) Date of Patent: Jan. 8, 2013

(54) DUST REDUCING SANDING SYSTEM

(76) Inventor: Richard A. Brunner, Coatesville, PA (US)

( * ) Notice: Subject to any disclaimer, the term of this patent is extended or adjusted under 35 U.S.C. 154(b) by 124 days.

(21) Appl. No.: 12/558,877

(22) Filed: Sep. 14, 2009

(65) Prior Publication Data

US 2010/0233938 A1 Sep. 16, 2010

Related U.S. Application Data

(63) Continuation of application No. 11/536,834, filed on Sep. 29, 2006, now abandoned.

(51) Int. Cl.
*B24B 55/04* (2006.01)

(52) U.S. Cl. ..... 451/451; 451/354; 451/456

(58) Field of Classification Search ..... 15/451–457, 15/540–549, 356
See application file for complete search history.

(56) References Cited

U.S. PATENT DOCUMENTS 4,062,152 A * 12/1977 Mehrer ..... 451/344
4,598,500 A 7/1986 Faraudo et al.
4,680,895 A 7/1987 Roestenberg
4,697,389 A 10/1987 Romine
4,779,385 A * 10/1988 Reiter ..... 451/354
4,937,984 A 7/1990 Taranto
D310,012 S 8/1990 Henke et al.
4,964,243 A * 10/1990 Reiter ..... 451/354
5,007,206 A 4/1991 Paterson
5,036,627 A * 8/1991 Walters ..... 451/354
5,193,313 A * 3/1993 Sanchez et al. ..... 451/344
5,243,790 A * 9/1993 Gagne ..... 451/528
5,245,797 A * 9/1993 Milkie ..... 451/354
5,283,988 A 2/1994 Brown
6,049,941 A 4/2000 Vollenweider, II
6,971,952 B2 * 12/2005 Whitty ..... 451/357
7,169,029 B2 * 1/2007 Petersen et al. ..... 451/523
7,249,996 B1 * 7/2007 Volyar ..... 451/354

* cited by examiner

*Primary Examiner* — Dung Van Nguyen
(74) *Attorney, Agent, or Firm* — Cozen O'Connor

(57) ABSTRACT

A dust reducing sanding system for collecting dust created during the sanding of gypsum board includes a shroud including a top wall and a peripheral wall coupled to the top wall to define an interior space. A distal edge of the peripheral wall opposite the top wall defines an open end to allow the dust to enter the interior space. A handle is mounted to the shroud and is graspable to facilitate manipulation of the shroud. A collection pipe is coupled to the peripheral wall of the shroud and is in fluid communication with the interior space. The collection pipe is engaged by a vacuum to allow the dust to be vacuumed out of the shroud. A base plate having a plurality of apertures extending therethrough is positioned over the open end of the shroud. An exterior surface of the base plate is abrasive.

15 Claims, 6 Drawing Sheets

DUST REDUCING SANDING SYSTEM

PRIORITY

The present application is a continuation of and claims priority to U.S. patent application Ser. No. 11/536,834, filed Sep. 29, 2006, the disclosure of which is hereby incorporated by reference in its entirety.

FIELD OF THE INVENTION

The present invention relates to sander dust collectors and more particularly pertains to a new sander dust collector for collecting dust created during the sanding of gypsum board.

BACKGROUND OF THE INVENTION

The use of sander dust collectors is known in the prior art. While these devices fulfil their respective, particular objectives and requirements, the need remains for a system that has certain improved features that has a shroud and an abrasive base plate attached thereto that allows a vacuum to collect the dust entering the shroud when dust is formed by the abrasive plate sanding gypsum board. This will allow the user of the system to change plates as needed to vary the grit of the plate. Additionally, a sand mesh may be attached to the base plate to alter the grit of the abrasive being used on the gypsum board.

SUMMARY OF THE INVENTION

The present invention meets the needs presented above by generally comprising a shroud including a top wall and a peripheral wall coupled to the top wall. The top wall and the peripheral wall define an interior space of the shroud. A distal edge of the peripheral wall opposite the top wall defines an open end of the shroud. The open end is in communication with the interior space to allow the dust to enter the interior space. A handle is mounted to the shroud. The handle is graspable to facilitate manipulation of the shroud. A collection pipe is coupled to the peripheral wall of the shroud. The collection pipe is in fluid communication with the interior space of the shroud. The collection pipe is engaged by a vacuum to allow the dust to be vacuumed out of the shroud. A base plate comprising a grid is mounted to the shroud. The base plate is positioned over the open end of the shroud. An exterior surface of the base plate is abrasive.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

In order that the invention may more readily be understood, reference is directed to the accompanying drawings.

DETAILED DESCRIPTION

Figure 1:
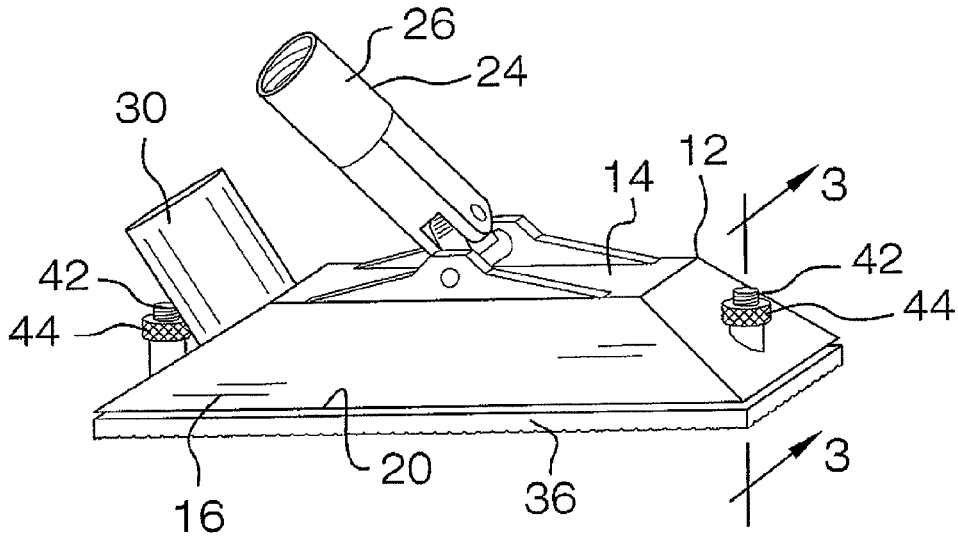
FIG. 1 is a perspective view of a dust reducing sanding system 30 according to the present invention.
Figure 2:
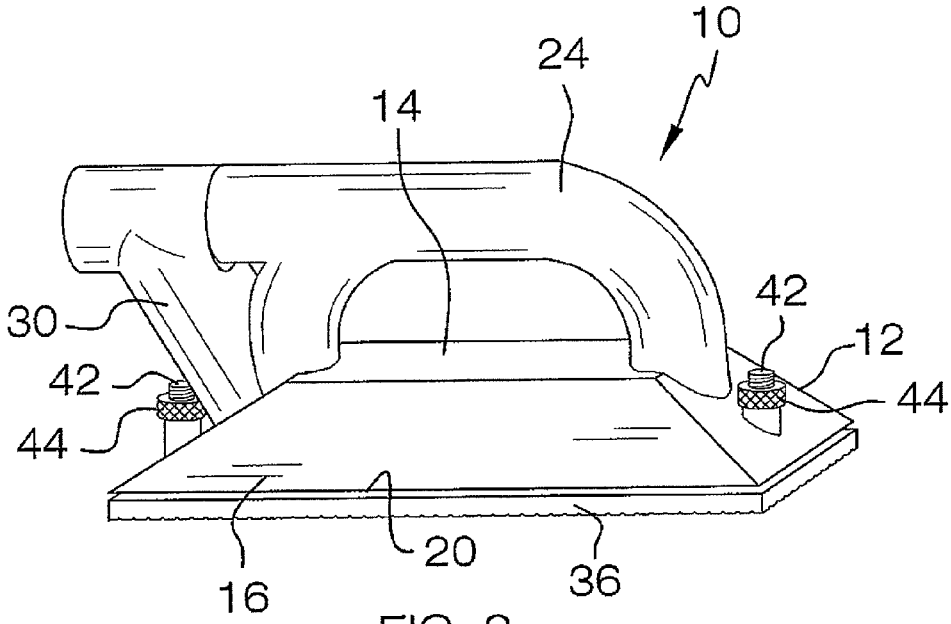
FIG. 2 is a perspective view of an embodiment of the present invention.
Figure 3:
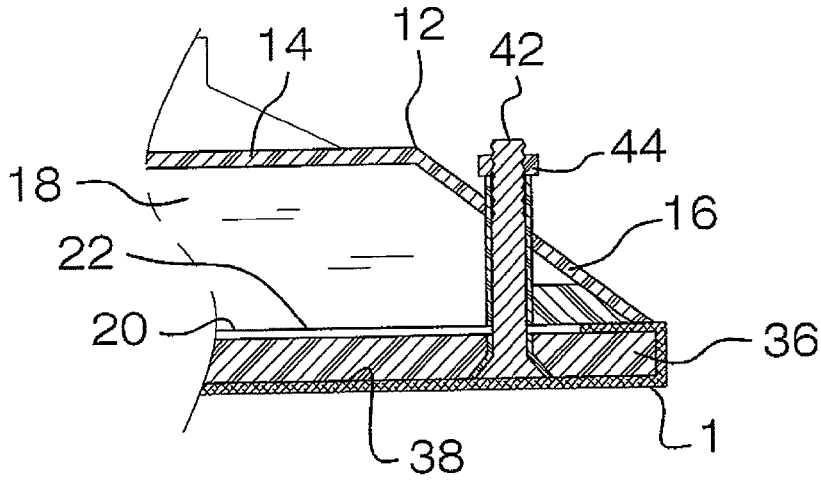
FIG. 3 is a cross-sectional view of the present invention taken 5 along line 3-3 of FIG. 1.
Figure 4:
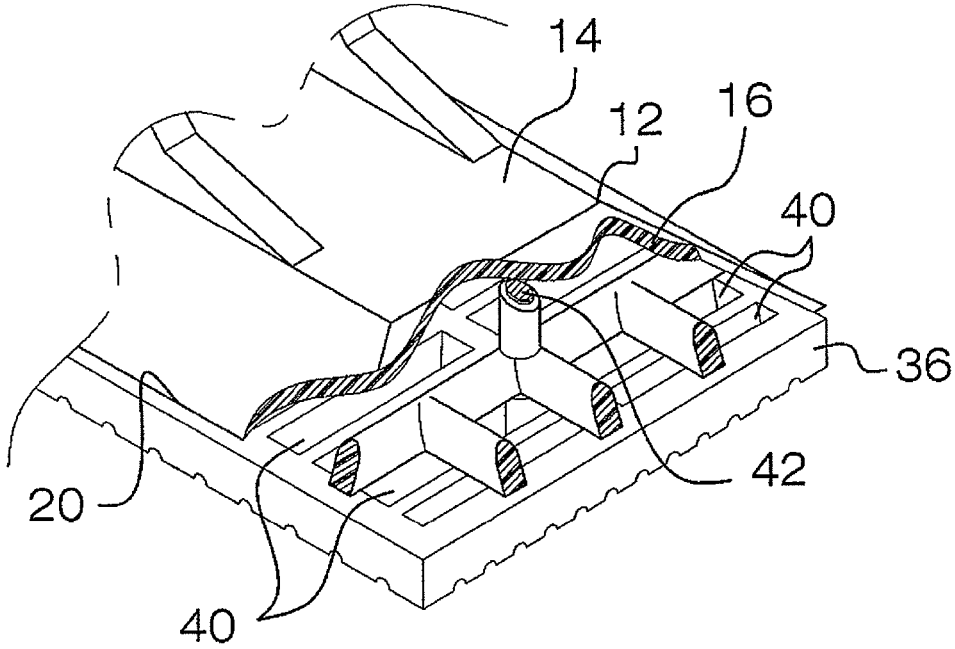
FIG. 4 is an enlarged partial cut away perspective view of the present invention shown a portion of the shroud cut away.
Figure 5:
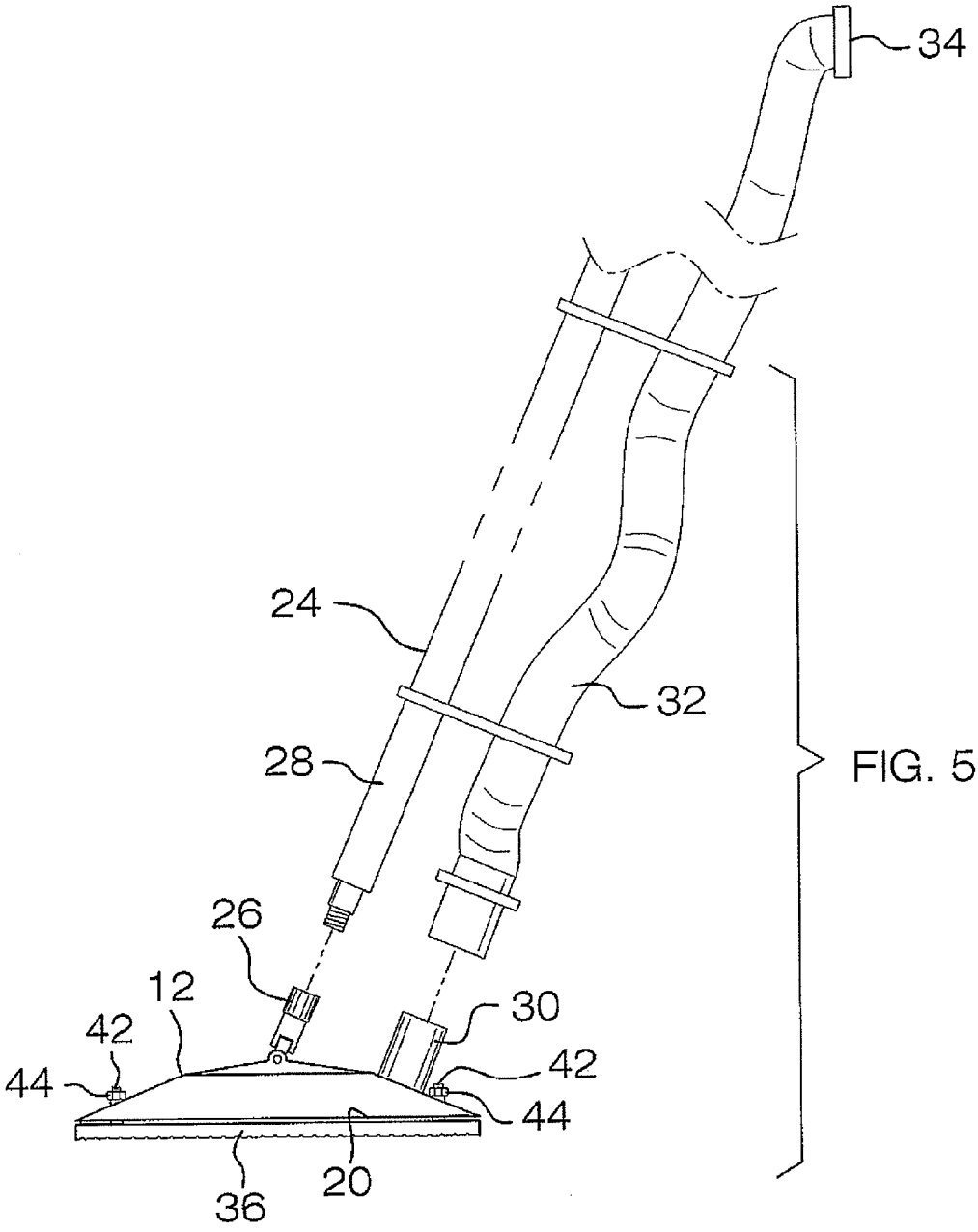
FIG. 5 is a side view of an embodiment of the present invention.

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention. Therefore, with reference now to the drawings, and in particular to FIGS. 1 through 8 thereof, a new sander dust collector embodying the principles and concepts of the present invention and generally designated by the reference numeral 10 will be described.

As best illustrated in FIGS. 1 through 8, the dust reducing sanding system 10 generally comprises a shroud 12 including a top wall 14 and a peripheral wall 16 coupled to the top wall 14. The top wall 14 and the peripheral wall 16 define an interior space 18 of the shroud 12. A distal edge 20 of the peripheral wall 16 opposite the top wall 14 defines an open end 22 of the shroud 12. The open end 22 is in communication with the interior space 18 to allow the dust to enter the interior space 18.

A handle 24 is mounted to the shroud 12. The handle 24 is graspable to facilitate manipulation of the shroud 12. As shown in FIGS. 1, 5, 7 and 8, the handle 24 includes a sleeve 26 pivotally coupled to the top wall 14 of the shroud 12. An elongated pole 28 is mountable to the sleeve 26. The elongated pole 28 is graspable to permit the shroud 12 to be manipulated at a distance from a person grasping the handle 24.

A collection pipe 30 is coupled to the peripheral wall 16 of the shroud 12. The collection pipe 30 is in fluid communication with the interior space 18 of the shroud 12. A hose 32 is coupled to the collection pipe 30. A free end 34 of the hose 32 is coupled to a vacuum, wherein the vacuum vacuums dust in the interior space 18 through the hose 32 to be collected in the vacuum.

Figure 6A:
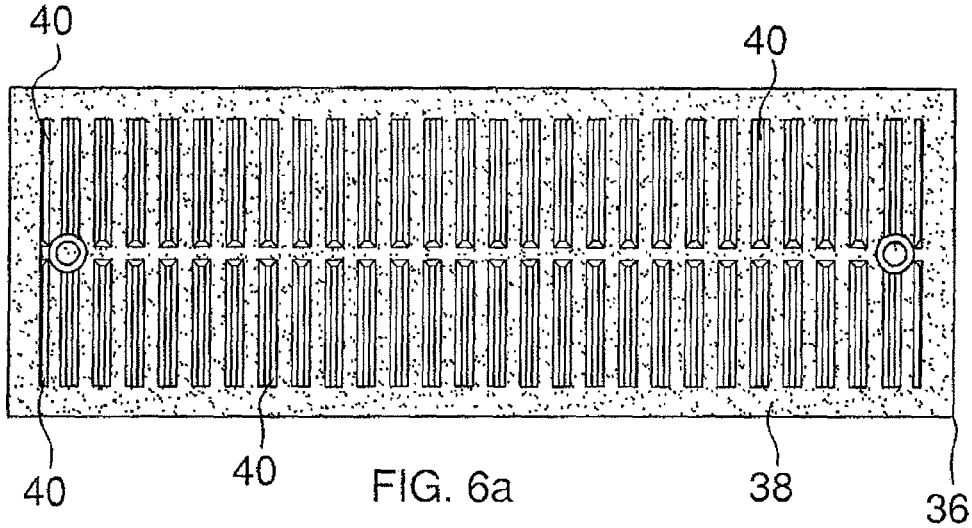
FIG. 6*a* is a bottom view of the base plate of the present invention.
Figure 6B:
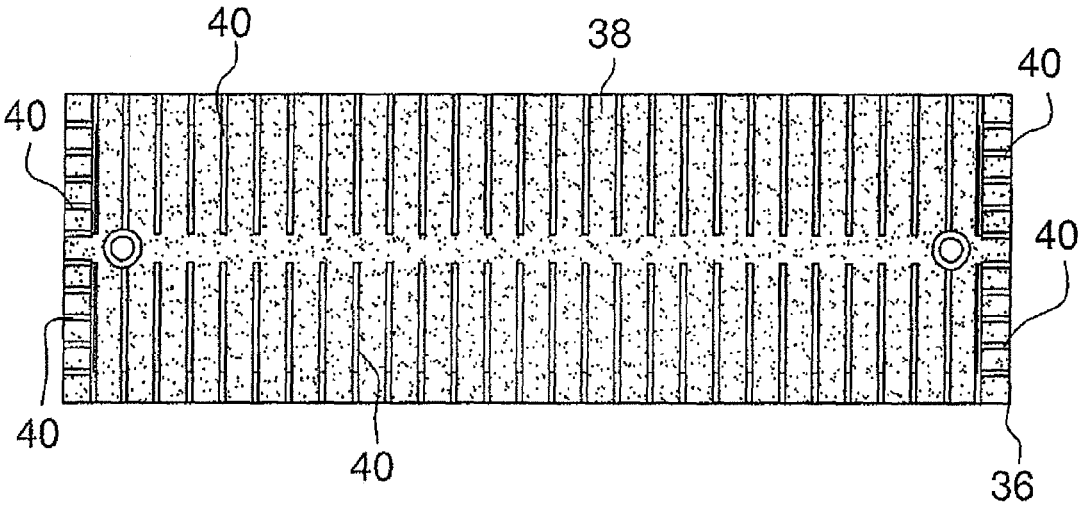
FIG. 6*b* is a bottom view of an embodiment of the base plate of the 15 present invention showing a different configuration of apertures from that shown in FIG. 6*a*.

A base plate 36 is mounted to the shroud 12. The base plate 36 is positioned over the open end 22 of the shroud 12. An exterior surface 38 of the base plate 36 is abrasive. It is to be understood that base plate 36 will be provided in a plurality of different grit designations so that different base plates 36 may be needed. Embedding abrasive materials, such as industrial diamonds, into a support medium such as a metal, elastomer or plastic, may form the base plate 36. The base plate 36 has a grid pattern and a plurality of apertures 40 extending therethrough. Each of the apertures 40 permits the vacuum to suction dust through the base plate 36. Sanding mesh 1 may be attached to the base plate by extending the edges of the mesh 1 around the edges of the base plate 36 and securing them between the shroud 12 and the base plate 36. FIGS. 6*a* and 6*b* show alternate configurations of the apertures 40 extending through said base plate 36.

In an exemplary embodiment, the abrasive material of the base plate 36 will be aluminum oxide or aluminum oxide crystals. Aluminum oxide or aluminum oxide crystals are widely used as a coarse or fine abrasive, including as a much less expensive substitute for industrial diamond. In addition, its low heat retention and low specific heat make it widely used in sanding operations. In additional embodiments, aluminum oxide, flint, garnet, emery, silicon carbide, alumina-zirconia (an aluminium oxide-zirconium oxide alloy), chromium oxide, ceramic aluminum oxide or any other suitable material or combinations thereof, may be utilized as the abrasive material of the base plate 36.

The base plate 36 can be made from and Epoxy or polyepoxide, which is a thermosetting polymer formed from reaction of an epoxide "resin" with polyamine "hardener". For example, the abrasive material is added to the Epoxy as the base plate is being made.

In another embodiment, the base plate 36 is made by an injection molding system and the abrasive material is added to the liquid plastic polymer before it is added to the base plate's mold. Injection molding is a manufacturing process for producing parts from both thermoplastic and thermosetting plastic materials. Material is fed into a heated barrel, mixed, and forced into a mold cavity where it cools and hardens to the configuration of the mold cavity. After a product is designed, usually by an industrial designer or an engineer, molds are made by a moldmaker (or toolmaker) from metal, usually either steel or aluminum, and precision-machined to form the features of the desired part. Injection molding is widely used for manufacturing a variety of parts, from the smallest component to entire body panels of cars. Alternatively, the abrasive material may be placed in the mold and the liquid plastic polymer is then injected into the mold to produce a first layer of abrasive mixed with plastic followed by to pure liquid plastic polymer. The base plate 36 can also be constructed of a metal, such as cast aluminum with the abrasive embedded in the casting.

The base plate 36 has a grid pattern and a plurality of apertures 40 extending therethrough. Each of the apertures 40 permits the vacuum to suction dust through the base plate 36. Sanding mesh 1 may be attached to the base plate by extending the edges of the mesh 1 around the edges of the base plate 36 and securing them between the shroud 12 and the base plate 36. FIGS. 6*a* and 6*b* show alternate configurations of the apertures 40 extending through said base plate 36.

Each of a plurality of fasteners 42 is extendable through the base plate 36 and the shroud 12. Each of the fasteners 42 threadably receives one of a plurality of securing nuts 44. The securing nuts 44 abut the shroud 12 to secure the fasteners 42 and the base plate 36 to the shroud 12 when the securing nuts 44 threadably engage the fasteners 42. Each of the securing nuts 44 is knurled to facilitate gripping of the securing nuts 44 when the securing nuts 44 are to be manipulated with respect to the fasteners 42.

Figure 7:
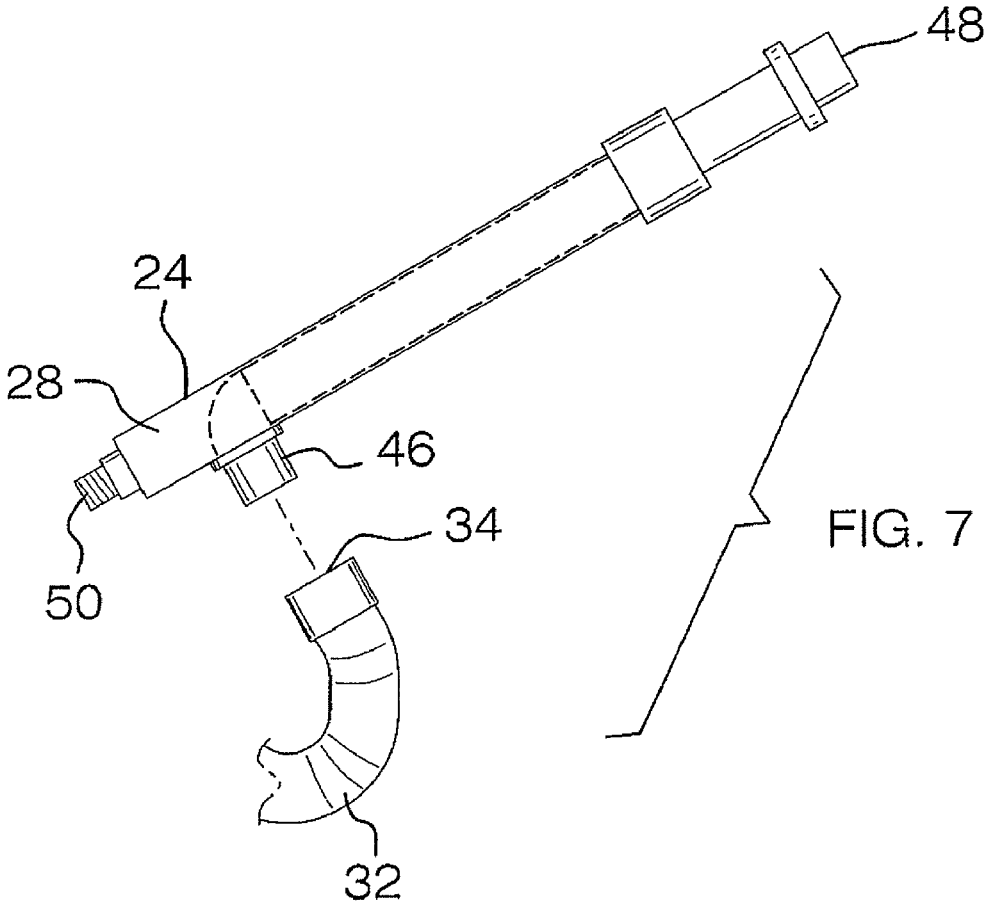
FIG. 7 is a side view of an embodiment of the handle of the present invention.
Figure 8:
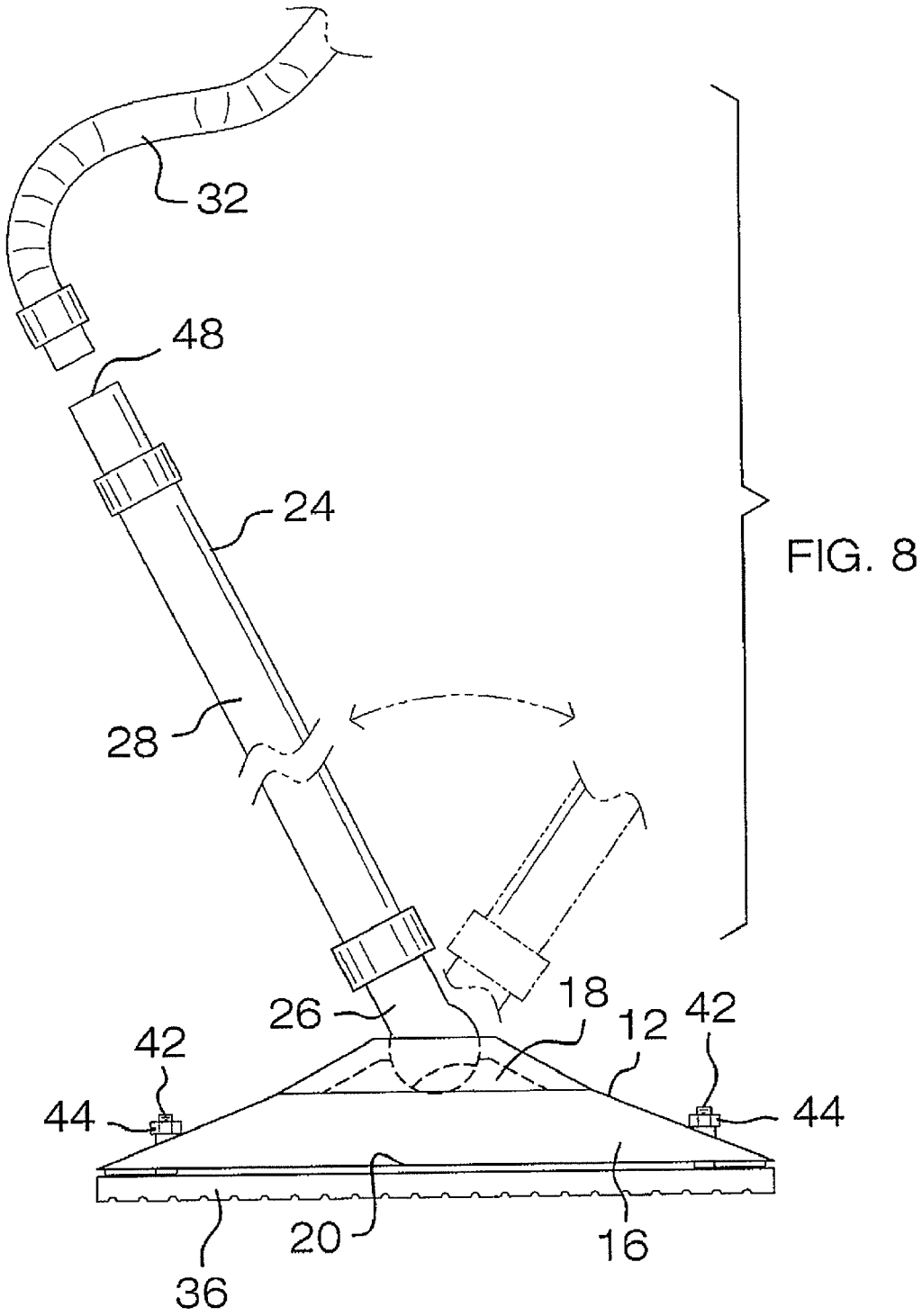
FIG. 8 is a side view of an embodiment of the handle of the present invention.

In an embodiment, as shown in FIG. 7, the elongated pole 28 is hollow. The elongated pole 28 includes a connection tube 46 extending outwardly from the elongated pole 28 and being in fluid communication with the elongated pole 28. The free end 34 of the hose 32 is mounted to the connection tube 46. A distal end 48 of the handle 24 positioned opposite the sleeve 26 engages the vacuum to permit the vacuum to vacuum dust through the elongated pole 28 and the hose 32. The connection tube 46 is positioned adjacent a mounting end 50 of the elongated pole 28. The mounting end 50 engages the sleeve 26 to mount the elongated pole 28 to the sleeve 26. In an embodiment, as shown in FIG. 8, the sleeve 26 and the collection pipe 30 are incorporated into a single unit allowing the elongated pole 28 to by in fluid communication with the sleeve 26 and allow the dust to be vacuumed through the elongate pole and the sleeve 26.

In use, the desired base plate 36 is attached to the shroud 12. The 30 hose 32 is coupled to the collection pipe 30 and the free end 34 of the hose 32 is mounted to the vacuum. The vacuum is turned on to allow dust and debris created from the scraping of the base plate 36 over a work surface to be vacuumed through the base plate 36, the shroud 12, the collection pipe 30 and the hose 32 to be collected in the vacuum. This reduces the exposure of a person to airborne particulates created by the sanding process.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Finally, it is to be understood that various alterations, modifications and/or additions may be introduced into the constructions and arrangements of parts previously described without departing from the spirit or ambit of the invention.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A dust reducing sanding system for being connected to a vacuum to collect dust during sanding, said system comprising:

a shroud including a top wall and a peripheral wall coupled to said top wall, said top wall and said peripheral wall defining an interior space of said shroud, a distal edge of said peripheral wall opposite said top wall defining an open end of said shroud, said open end being in communication with said interior space to allow the dust to enter the interior space;

a handle being mounted to said shroud, said handle being graspable to facilitate manipulation of said shroud;

a collection pipe being coupled to said peripheral wall of said shroud, said collection pipe being in fluid communication with said interior space of said shroud said collection pipe being engaged by the vacuum to permit the dust to be vacuumed out of said shroud; and an abrasive material embedded into a substantially rigid base plate formed from an epoxy or polyepoxide and exposed to a first surface, said base plate being removably mounted to said shroud, and positioned over said open end of said shroud, said base plate having a plurality of apertures extending therethrough.

2. The system according to claim 1, wherein said abrasive of said base plate is a composition of aluminum oxide and a polymer.

3. The system according to claim 1, wherein said abrasive material is chosen from: flint, garnet, emery, silicon carbide, alumina-zirconia, chromium oxide, any other suitable material or a combination thereof.

4. The system according to claim 1, wherein said base plate is formed in an injection molding manner.

5. The system according to claim 1, wherein said shroud, handle, collection pipe and base plate are formed in an injection molding manner.

6. The system according to claim 1, wherein said shroud, handle, collection pipe and base plate are formed by epoxy or polyepoxide.

7. The system according to claim 1, wherein said handle includes a sleeve being pivotally coupled to said top wall of said shroud.

8. The system according to claim 7, wherein said handle includes an elongated pole being mountable to said sleeve, said elongated pole being graspable to permit said shroud to be manipulated at a distance from a person grasping said handle.

9. The system according to claim 8, wherein said elongated pole is hollow, said elongated pole including a connection tube extending outwardly from said elongated pole and being in fluid communication with said elongated pole, said free end of said hose being mounted to said connection tube, a distal end of said handle positioned opposite said sleeve engaging the vacuum the vacuum to permit the vacuum to vacuum dust through said elongated pole and said hose.

10. The system according to claim 9, wherein said connection tube is positioned adjacent a mounting end of said elongated pole, said mounting end engaging said sleeve to mount said elongated pole to said sleeve.

11. The system according to claim 1, further comprising a plurality of fasteners, each of said fasteners being extendable through said base plate and said shroud.

12. The system according to claim 11, further comprising a plurality of securing nuts, each of said fasteners threadably receiving one of said securing nuts, said securing nuts abutting said shroud to secure said fasteners and said base plate to said shroud when said securing nuts threadably engage said fasteners.

13. The system according to claim 12, wherein each of said securing nuts is knurled to facilitate gripping of said securing nuts when said securing nuts are to be manipulated with respect to said fasteners.

14. The system according to claim 1, further comprising a hose being coupled to said collection pipe, a free end of said hose being coupled to the vacuum, wherein the vacuum vacuums dust in said interior space through said hose to be collected in the vacuum.

15. A dust reducing sanding system for being connected to a vacuum to collect dust during sanding, said system comprising:

a shroud including a top wall and a peripheral wall coupled to said top wall, said top wall and said peripheral wall defining an interior space of said shroud, a distal edge of said peripheral wall opposite said top wall defining an opposite said top wall defining an open end of said shroud, said open end being in communication with said interior space to allow the dust to enter the interior space;

a handle being mounted to said shroud, said handle being graspable to facilitate manipulation of said shroud, said handle including;

a sleeve being pivotally coupled to said top wall of said shroud;

an elongated pole being mountable to said sleeve, said elongated pole being graspable to permit said shroud to be manipulated at a distance from a person grasping said handle;

a collection pipe being coupled to said peripheral wall of said shroud, said collection pipe being in fluid communication with said interior space of said shroud;

a hose being coupled to said collection pipe, a free end of said hose being coupled to the vacuum, wherein the vacuum vacuums dust in said interior space through said hose to be collected in the vacuum;

an abrasive material embedded into a substantially rigid base plate formed from an epoxy or polyepoxide and exposed to a first surface, said base plate being mounted to said shroud and positioned over said open end of said shroud, said base plate further comprising a grid having a plurality of apertures extending therethrough, each of said apertures permitting the vacuum to vacuum dust through said base plate and a sanding mesh when the sanding mesh is used to sand a surface;

a plurality of fasteners, each of said fasteners being extendable through said base plate and said shroud; and a plurality of securing nuts, each of said fasteners threadably receiving one of said securing nuts, said securing nuts abutting said shroud to secure said fasteners and said base plate to said shroud when said securing nuts threadably engage said fasteners, each of said securing nuts being knurled to facilitate gripping of said securing nuts when said securing nuts are to be manipulated with respect to said fasteners.

* * * * *

UNITED STATES PATENT AND TRADEMARK OFFICE

CERTIFICATE OF CORRECTION

PATENT NO. : 8,348,726 B2
APPLICATION NO. : 12/558877
DATED : January 8, 2013
INVENTOR(S) : Richard A. Brunner It is certified that error appears in the above-identified patent and that said Letters Patent is hereby corrected as shown below:

Column 5, line 46, after "the vacuum", delete "the vacuum".

Signed and Sealed this
Nineteenth Day of March, 2013

Teresa Stanek Rea
*Acting Director of the United States Patent and Trademark Office*